United States Patent [19]

Fuller

[11] Patent Number: 4,695,146

[45] Date of Patent: Sep. 22, 1987

[54] FUME EXHAUST SYSTEM FOR PHOTO PRINT PROCESSORS

[76] Inventor: Charles L. Fuller, 2340 Loma Linda St., Sarasota, Fla. 33579

[21] Appl. No.: 917,772

[22] Filed: Oct. 10, 1986

[51] Int. Cl.[4] ..... G03D 13/00

[52] U.S. Cl. ..... 354/309; 355/30

[58] Field of Search ..... 354/300, 307, 308, 309; 355/30, 27, 28

[56] References Cited

U.S. PATENT DOCUMENTS

| | | | |
|---|---|---|---|
| 2,975,695 | 3/1961 | Tsuno | 354/308 |
| 3,208,335 | 9/1965 | Doherty | 354/308 |
| 4,059,409 | 11/1977 | Barto | 354/300 |
| 4,377,331 | 3/1983 | Seelenbinder et al. | 354/300 |

*Primary Examiner*—A. A. Mathews

*Attorney, Agent, or Firm*—Charles J. Prescott

[57] ABSTRACT

A fume and heat exhaust system to be used in conjunction with a high-speed photo print processor which requires for its operation that the user be positioned in close proximity to the processor front panel. The processor front panel includes an opening for finished photo discharge into a tray therebelow. The invention, connectable to the front panel, includes a blower having an inlet matably aligned with one end of a rigid contoured hood, the upper margin of which is mounted against the front panel above the opening. The rigid hood is contoured outwardly and downwardly to its lower, outer margin to cover the opening and tray such that the heated fumes which discharge and rise from the opening are collected within the chamber formed by the inner surface of the hood and front panel for removal by the blower. The lower margin of the hood may also include a flexible curtain downwardly disposed therefrom to further reduce the quantity of heated fumes escaping from the chamber while still allowing user access to, and viewing the contents of, the tray. The hood and curtain may be transparent to provide said user visibility of tray contents. A flexible exhaust hose may also be connected to the blower outlet for conveying the heated fumes away from the user's work area.

6 Claims, 3 Drawing Figures

FUME EXHAUST SYSTEM FOR PHOTO PRINT PROCESSORS

BACKGROUND OF THE INVENTION

This invention relates generally to color photo print processor accessories, and more particularly to a heat and fume exhaust system as an accessory to photo print processors to provide a safer work area for the user of such processors.

Applicant, in his business, uses a well-known commercially available high-speed photo print processor manufactured and distributed by KIS Photo under their trade name "KIS Magnum Speed" and/or "KIS/30". This unit, as well as other high-speed photoprinters, are utilized by quick photo print shops throughout the United States and world wide. The KIS unit includes a tank housing and the photoprocessing mechanism housed therein in front of which the user must routinely operate in order to produce photographs. Enclosed within the tank housing, servicable from above after a hinged closure forming a portion of the copier top surface is opened, are a plurality of chemical tanks and a drying unit for finish processing photographs. The photographs are discharged from an opening into a tray on the front panel of such units. Mounted atop the tank housing is an exposure head and control by which the user regulates the accurate color and density consistencies of the photographs produced.

Because of this typical arrangement, the user is exposed to continuous heavy doses of heated air and heated chemical fumes which exhaust primarily from the opening in the front panel. These heated air and heated chemical fumes routinely cause topical skin problems, and in some instances, degradation of internal organs because of the necessity for the user to breath these fumes while operating the machine. Applicant is aware that, if not all, then the majority of users of these machines, as applicant has, ultimately experience some form of physical degradation due to repeated and continuous exposure to these fumes.

To applicant's knowledge, no accessory is available through any of the photo print processor manufacturers or otherwise to relieve this damaging physical condition as an inherent risk of such use. However, because of the lucrative nature of the franchise business utilizing such high-speed photo print processors, this condition has gone virtually unattended.

The present invention provides a system having a blower in conjunction with a molded hood and associated flexible duct or hose assembled to the front panel of the photo print processor in an arrangement whereby these heated air and exhaust gases are removed away from the front panel of the machine and the user so as to virtually eliminate this problem.

BRIEF SUMMARY OF THE INVENTION

This invention is directed to a fume and heat exhaust system to be used in conjunction with a high-speed photograph printer which requires for its operation that the user be positioned in close proximity to the processor front panel. The processor front panel includes an opening for finished photo discharge into a tray therebelow. The invention, connectable to the front panel, includes a blower having an inlet matably aligned with one end of a rigid contoured hood, the upper margin of which is mounted against the front panel above the opening. The rigid hood is contoured outwardly and downwardly to its lower, outer margin to cover the opening and tray such that the heated fumes which discharge and rise from the opening are collected within the chamber formed by the inner surface of the hood and front panel for removal by the blower. The lower margin of the hood may also include a flexible curtain downwardly disposed therefrom to further reduce the quantity of heated fumes escaping from the chamber while still allowing user access to the tray. The hood and curtain may be transparent to provide user visibility of tray contents. A flexible exhaust hose may also be connected to the blower outlet for conveying the heated fumes away from the user's work area.

It is therefore an object of this invention to provide an accessory heat and fume exhaust system adapted to high speed photo processors to remove heated air and heated chemical fumes thereaway from.

It is another object of this invention to provide an accessory heat and fume exhaust system for commercially available photo processors which will alleviate the health and skin condition problems posed by such photo processors on its users.

It is another object to provide the above exhaust system which will economically render such high speed photo processors safe for use by the elimination of heated air and heated chemical fumes from in front of these machines where users must position themselves during its operation.

In accordance with these and other objects which will become apparent hereinafter, the instant invention will now be described with reference to the accompanying drawings in which:

DETAILED DESCRIPTION OF THE INVENTION

Figure 1:
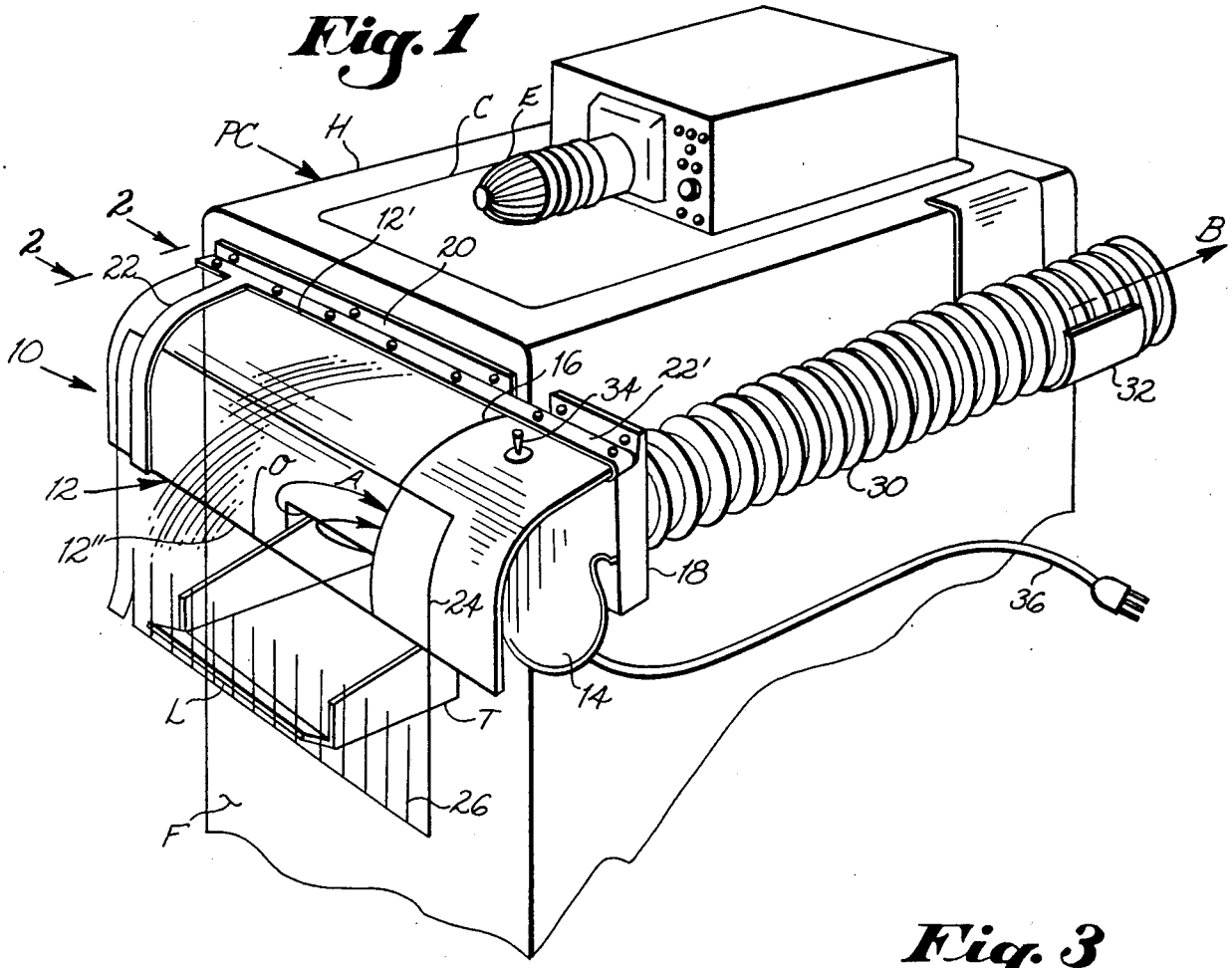
FIG. 1 is a perspective view of the invention as installed onto the front panel of a high-speed photo print processor.

Referring now to the drawings, the present invention is shown generally at numeral 10 as it is assembled to the front panel F of a high-speed photo print processor PC. The invention 10 includes a rigid molded clear plastic hood 12 which is attachable to the front panel F by L-bracket 20 along the upper margin 12' of the hood 12. The L-bracket 20, in the preferred embodiment, also includes rigid hood end form extension 22 which is matably attached against and supports the left end margin of hood 12.

The contour of hood 12 is adapted to mate with the inlet 16 of squirrel cage blower 14, which is connected by conventional power cord 36 to an available alternating current power source. L-bracket 20 is elongated at 22' to also serve as the mounting support for blower 14. A length of flexible exhaust hose 30 is connected to the outlet 18 of blower 14 and, in its shortest embodiment, is support by bracket 32 attached to the side of the photo print processor PC as shown to support hose 30.

The photo print processor PC includes a tank housing H which encloses a plurality of chemical tanks and a drying unit for finish processing the photographs. These tanks are positioned beneath the closure C which is hinged at its rear margin to open upwardly for servicing and filling these tanks. The photo drying unit is positioned inside the housing adjacent the front panel F.

Figure 2:
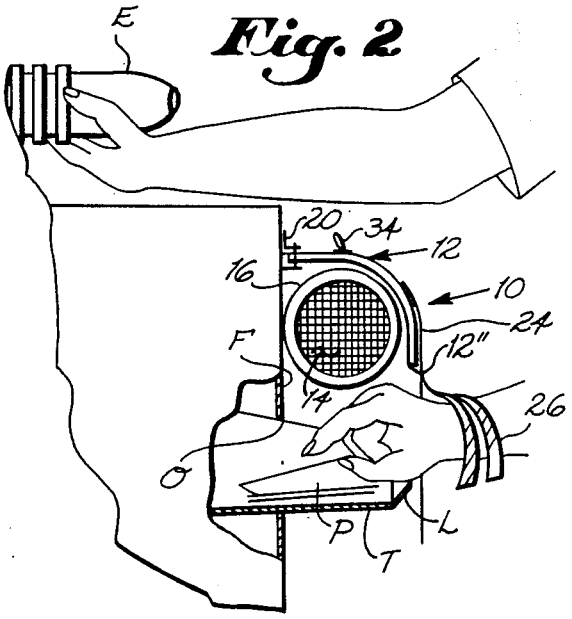
FIG. 2 is a side elevation view of the invention in the direction of arrows 2—2 in FIG. 1.
Figure 3:
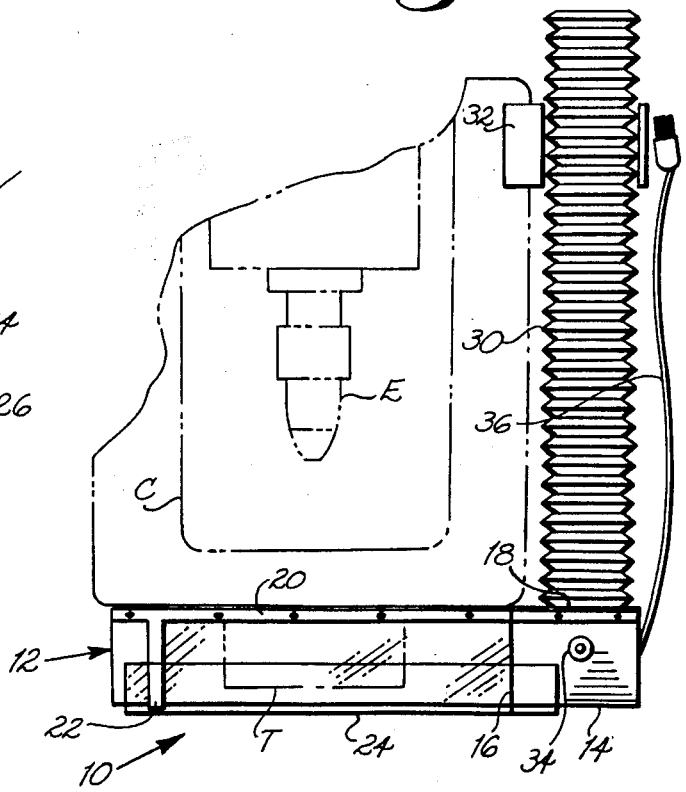
FIG. 3 is a top plan view of the invention showing the top of a high-speed photo print processor to which it is assembled in phantom.

As shown in FIG. 1, hot air and exhaust gasses are discharged from opening O in the front panel F in the direction of arrows A. Because the inner surface of the hood 12, in combination with the front panel F, form an inverted downwardly opening chamber, the hot air and heated chemical fumes are trapped and drawn away in the direction of arrows A by blower 14 and discharged out of hose 30 in the direction of arrow B. As best seen in FIG. 2, the importance of this hot air and heated gas removal is shown graphically by incorporating the typical arm and hand positioning of a user during operation of the photocopier. One hand is required to adjust the exposure head and control E on a picture-by-picture basis. This places the hand and arm directly above the normally rising hot air and heated chemical gases. Additionally, one of the user's hands is required to remove the finished photographs P which discharge out through opening O into tray T. This photograph removal places the user's hand in direct alignment and contact also with the discharging hot gasses.

During experiments conducted by Applicant, the normal operating temperature existing in the vicinity of the tray T, where the user's arms, hands and upper torso are positioned, is in excess of one hundred and thirty degrees fahrenheit (130° F.). Similar temperature measurements having the present invention in place and in operation reduced the same temperatures to below eighty degrees fahrenheit (80° F.). This substantial difference in temperature, in combination with the elimination of hot chemical gases, greatly enhances the overall safety and comfort of the work environment in conjunction with the use of such photocopiers.

In the preferred embodiment, applicant has included a flexible curtain 24 fabricated of a sheet of transparent flexible and pliable plastic material and which is connected by adhesive means to overlap onto and be supported by the outer surface of hood 12 as shown. The lower margin of this flexible curtain 24 is disposed so as to hang in front of the tray T and opening O and below the lip I of the tray T so as to maximize the protection and hot gas removal features offered by the present invention. To maintain this optimum protection, and also to retain the easy access by the user to the photographs P deposited into tray T, a plurality of upwardly extending slits 26 are also provided in the curtain 24. These slits 26 facilitate, as best seen in FIG. 2, the user's hand entry into the tray for photo pickup.

Although the preferred embodiment of the exhaust hose 30 is shown in a short version so as to discharge the hot gasses in the direction of arrow B toward the back of the photo print processor PC, the length of this flexible hose may be increased to discharge these hot gasses into a remote portion of the workroom or into an exhaust vent for discharge outside of the workroom.

While the instant invention is shown and described herein in what is conceived to be the most practical and preferred embodiment, it is recognized that departures may be made therefrom within the scope of this invention, which is therefore not to be limited to the details disclosed herein, but is to be accorded the full scope of the claims so as to embrace any and all equivalent apparatus and articles.

What is claimed is:

1. A fume and heat exhaust system adapted for installation in conjunction with the front panel of a photo print processor the front panel having a photo discharge opening and a photo tray below the discharge opening, said system comprising:

an air blower having an inlet and an outlet;

a rigid hood having opposing upper and lower edge margins and opposing right and left end margins, said hood contoured of a thin sheet of material for mating alignment of said hood right end margin with said blower inlet;

hood mounting means for attaching said hood along said hood upper edge margin against the front panel of the photo print processor above the photo discharge opening;

blower mounting means for positioning said blower inlet adjacent said hood right end margin;

said hood extending outwardly and downwardly from said hood upper edge margin to said hood lower edge margin, said hood lower edge margin positioned such that said hood substantially covers the photo discharge opening and tray;

said blower outlet directed away from the photo discharge opening and tray.

2. A fume and heat exhaust system as set forth in claim 1, further comprising:

a flexible curtain formed of a pliable sheet of material connected along its upper edge margin to said hood adjacent said hood lower edge margin, said curtain downwardly exending down to said curtain lower edge margin;

said curtain having a plurality of slits upwardly extending from said curtain lower edge margin but not to said curtain upper edge margin.

3. A fume and heat exhaust system as set forth in claim 2, wherein:

said hood and curtain are transparent.

4. A fume and heat exhaust system as set forth in claim 1, further comprising:

a length of flexible exhaust hose connected at one end to said blower outlet and the other end of said exhaust hose directed away from the photo print processor.

5. A fume and heat exhaust system as set forth in claim 3, further comprising:

a support bracket connected to the side of the photo print processor for supporting a portion of said exhaust hose.

6. In combination with a photo print processor having a chemical tank housing and chemical and drying tanks within said housing for producing photographs, said housing having a front panel with an opening for discharging finished photographs, and a photo tray positioned below said opening, said tank producing heated air and chemical fumes from said opening during operation of said copier which operation requires the user to be positioned in close proximity to the heated air and chemical fumes discharging from said opening, the improvement comprising:

an air blower having an inlet and an outlet;

a rigid hood having opposing edge margins and opposing end margins and contoured of a thin sheet of material for mating alignment of one said end margin with said blower inlet;

hood mounting means for attaching said hood along one said hood edge margin against the front panel of the photo print processor above the photo discharge opening;

blower mounting means for positioning said blower inlet adjacent said one hood end margin;

said hood extending outwardly and downwadly from said one hood edge margin to said other hood edge margin, said hood and front panel forming a dowwardly opening chamber for collecting the heated air and heated chemical fumes discharging from said opening for removal by said blower out of said blower outlet;

said blower outlet directed away from the photo discharge opening and tray.

* * * * *